US009051792B2

(12) United States Patent
Herberg et al.

(10) Patent No.: US 9,051,792 B2
(45) Date of Patent: Jun. 9, 2015

(54) WELLBORE TOOL WITH EXCHANGEABLE BLADES

(75) Inventors: Wolfgang E. Herberg, Niedersachsen (DE); Ines Gruetzmann, Lehrte-Arpke (DE)

(73) Assignee: Baker Hughes Incorporated, Houston, TX (US)

( * ) Notice: Subject to any disclaimer, the term of this patent is extended or adjusted under 35 U.S.C. 154(b) by 974 days.

(21) Appl. No.: 13/186,915

(22) Filed: Jul. 20, 2011

(65) Prior Publication Data

US 2012/0018173 A1 Jan. 26, 2012

Related U.S. Application Data

(60) Provisional application No. 61/366,474, filed on Jul. 21, 2010.

(51) Int. Cl.

| | |
|---|---|
| ***E21B 10/32*** | (2006.01) |
| ***E21B 10/62*** | (2006.01) |
| ***E21B 17/00*** | (2006.01) |
| ***E21B 47/12*** | (2012.01) |

(52) U.S. Cl.

CPC ..... *E21B 10/32* (2013.01); *E21B 10/62* (2013.01); *E21B 17/003* (2013.01); *E21B 47/12* (2013.01)

(58) Field of Classification Search

CPC ..... E21B 10/322
USPC ..... 175/263, 258, 406
See application file for complete search history.

(56) References Cited

U.S. PATENT DOCUMENTS

| | | | |
|---|---|---|---|
| 1,678,075 | A | 7/1928 | Phipps |
| 2,069,482 | A | 2/1937 | Seay |
| 2,177,721 | A | 10/1939 | Johnson et al. |
| 2,344,598 | A | 3/1944 | Church |
| 2,754,089 | A | 7/1956 | Kammerer, Jr. |
| 2,758,819 | A | 8/1956 | Kammerer, Jr. |
| 2,834,578 | A | 5/1958 | Carr |
| 2,882,019 | A | 4/1959 | Carr et al. |
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer |

(Continued)

FOREIGN PATENT DOCUMENTS

| | | | |
|---|---|---|---|
| EP | 246789 | A2 | 11/1987 |
| EP | 1036913 | A1 | 9/2000 |

(Continued)

OTHER PUBLICATIONS

International Search Report for International Application No. PCT/US2011/044815 dated Dec. 26, 2011, 4 pages.

(Continued)

*Primary Examiner* — Kenneth L Thompson
*Assistant Examiner* — Steven MacDonald
(74) *Attorney, Agent, or Firm* — TraskBritt

(57) ABSTRACT

A method for conducting a wellbore operation includes disconnecting a radially projecting member from a first sub without uncoupling a second sub from the first sub. The method may include also coupling the first sub to the second sub with a connector that includes an electrical connection. An associated apparatus may include a sub having at least one conductor connected to a connector; and at least one radially projecting member removably coupled to the sub.

16 Claims, 3 Drawing Sheets

(56) References Cited

U.S. PATENT DOCUMENTS

| | | | | |
|---|---|---|---|---|
| 3,224,507 | A | 12/1965 | Cordary, Jr. | |
| 3,425,500 | A | 2/1969 | Fuchs | |
| 3,433,313 | A | 3/1969 | Brown | |
| 3,556,233 | A * | 1/1971 | Gilreath et al. | 175/267 |
| 4,403,659 | A | 9/1983 | Upchurch | |
| 4,458,761 | A | 7/1984 | Van Vreeswyk | |
| 4,491,187 | A | 1/1985 | Russell | |
| 4,545,441 | A | 10/1985 | Williamson | |
| 4,589,504 | A | 5/1986 | Simpson | |
| 4,660,657 | A | 4/1987 | Furse et al. | |
| 4,690,229 | A | 9/1987 | Raney | |
| 4,693,328 | A | 9/1987 | Furse et al. | |
| 4,768,901 | A | 9/1988 | Reinauer et al. | |
| 4,842,083 | A | 6/1989 | Raney | |
| 4,848,490 | A | 7/1989 | Anderson | |
| 4,854,403 | A | 8/1989 | Ostertag et al. | |
| 4,884,477 | A | 12/1989 | Smith et al. | |
| 4,889,197 | A | 12/1989 | Boe | |
| 5,139,098 | A | 8/1992 | Blake | |
| 5,211,241 | A | 5/1993 | Mashaw et al. | |
| 5,224,558 | A | 7/1993 | Lee | |
| 5,265,684 | A | 11/1993 | Rosenhauch | |
| 5,293,945 | A | 3/1994 | Rosenhauch et al. | |
| 5,305,833 | A | 4/1994 | Collins | |
| 5,318,131 | A | 6/1994 | Baker | |
| 5,318,137 | A | 6/1994 | Johnson et al. | |
| 5,318,138 | A | 6/1994 | Dewey et al. | |
| 5,332,048 | A | 7/1994 | Underwood et al. | |
| 5,343,963 | A | 9/1994 | Bouldin et al. | |
| 5,361,859 | A | 11/1994 | Tibbitts | |
| 5,368,114 | A | 11/1994 | Tandberg et al. | |
| 5,375,662 | A | 12/1994 | Echols, III et al. | |
| 5,402,856 | A | 4/1995 | Warren et al. | |
| 5,425,423 | A | 6/1995 | Dobson et al. | |
| 5,437,308 | A | 8/1995 | Morin et al. | |
| 5,553,678 | A | 9/1996 | Barr et al. | |
| 5,560,440 | A | 10/1996 | Tibbitts et al. | |
| 5,740,864 | A | 4/1998 | de Hoedt et al. | |
| 5,765,653 | A | 6/1998 | Doster et al. | |
| 5,788,000 | A | 8/1998 | Maury et al. | |
| 5,823,254 | A | 10/1998 | Dobson et al. | |
| 5,887,655 | A | 3/1999 | Haugen et al. | |
| 5,931,239 | A | 8/1999 | Schuh | |
| 6,039,131 | A | 3/2000 | Beaton | |
| 6,059,051 | A | 5/2000 | Jewkes et al. | |
| 6,070,677 | A | 6/2000 | Johnston | |
| 6,109,354 | A | 8/2000 | Ringgenberg et al. | |
| 6,116,336 | A | 9/2000 | Adkins et al. | |
| 6,131,675 | A | 10/2000 | Anderson | |
| 6,189,631 | B1 | 2/2001 | Sheshtawy | |
| 6,213,226 | B1 | 4/2001 | Eppink et al. | |
| 6,220,375 | B1 | 4/2001 | Butcher et al. | |
| 6,227,312 | B1 | 5/2001 | Eppink et al. | |
| 6,289,999 | B1 | 9/2001 | Dewey et al. | |
| 6,325,151 | B1 | 12/2001 | Vincent et al. | |
| 6,378,632 | B1 | 4/2002 | Dewey | |
| 6,488,104 | B1 | 12/2002 | Eppink et al. | |
| 6,494,272 | B1 | 12/2002 | Eppink et al. | |
| 6,615,933 | B1 | 9/2003 | Eddison | |
| 6,668,949 | B1 | 12/2003 | Rives | |
| 6,708,785 | B1 | 3/2004 | Russell et al. | |
| 6,732,817 | B2 * | 5/2004 | Dewey et al. | 175/57 |
| 6,926,100 | B1 | 8/2005 | Anthony et al. | |
| 7,048,078 | B2 | 5/2006 | Dewey et al. | |
| 7,083,010 | B2 | 8/2006 | Eppink et al. | |
| 7,314,099 | B2 | 1/2008 | Dewey et al. | |
| 7,513,318 | B2 | 4/2009 | Underwood et al. | |
| 7,594,552 | B2 | 9/2009 | Radford et al. | |
| 7,823,657 | B2 | 11/2010 | Zeni | |
| 7,836,975 | B2 | 11/2010 | Chen et al. | |
| 7,882,905 | B2 | 2/2011 | Radford et al. | |
| 7,891,441 | B2 * | 2/2011 | Lee | 175/267 |
| 7,900,717 | B2 | 3/2011 | Radford et al. | |
| 7,926,596 | B2 | 4/2011 | Shen et al. | |
| 8,028,767 | B2 | 10/2011 | Radford et al. | |
| 2002/0070052 | A1 | 6/2002 | Armell | |
| 2003/0029644 | A1 | 2/2003 | Hoffmaster et al. | |
| 2004/0134687 | A1 | 7/2004 | Radford et al. | |
| 2008/0128174 | A1 | 6/2008 | Radford et al. | |
| 2008/0245570 | A1 * | 10/2008 | Partouche | 175/48 |
| 2009/0056938 | A1 * | 3/2009 | Treviranus et al. | 166/255.2 |
| 2010/0089583 | A1 | 4/2010 | Xu et al. | |
| 2010/0139981 | A1 | 6/2010 | Meister et al. | |
| 2010/0276199 | A1 | 11/2010 | Radford | |
| 2011/0284233 | A1 | 11/2011 | Wu et al. | |

FOREIGN PATENT DOCUMENTS

| | | | |
|---|---|---|---|
| EP | 1044314 | A1 | 3/2005 |
| GB | 2328964 | A | 3/1999 |
| GB | 2344607 | A | 6/2000 |
| GB | 2344122 | B | 4/2003 |
| WO | 0031371 | A1 | 6/2000 |

OTHER PUBLICATIONS

International Written Opinion for International Application No. PCT/US2011/044815 dated Dec. 26, 2011, 4 pages.

International Preliminary Report on Patentability for International Application No. PCT/US2011/044815 dated Jan. 22, 2013, 5 pages.

* cited by examiner

WELLBORE TOOL WITH EXCHANGEABLE BLADES

CROSS-REFERENCE TO RELATED APPLICATION

This application claims priority from U.S. Provisional Application Ser. No. 61/366,474 filed Jul. 21, 2010, the disclosure of which is incorporated herein by reference in its entirety.

BACKGROUND OF THE DISCLOSURE

1. Field of the Disclosure

This disclosure relates generally to oilfield downhole tools and more particularly to efficiently deploying well tools.

2. Background of the Art

Boreholes or wellbores are drilled by rotating a drill bit attached to the bottom of a drilling assembly (also referred to herein as a "Bottom Hole Assembly" or ("BHA"). The BHA may be attached to the bottom of a tubing or tubular string, which is usually either a jointed rigid pipe (or "drill pipe") or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a motor contained in the drilling assembly. In the case of a coiled tubing, the drill bit is rotated by the motor.

In certain instances, it may be desirable to enlarge a diameter of a section of a borehole with a hole opener. This borehole section may be an open hole or lined with a wellbore tubular such as a liner or casing. The present disclosure address the need for efficiently deploying hole openers and other tools for wellbore operations.

SUMMARY OF THE DISCLOSURE

In aspects, the present disclosure provides a method for conducting a wellbore operation that includes using a radially projecting member in a wellbore, the radially projecting member being positioned on a first sub; and disconnecting the radially projecting member from the first sub without uncoupling a second sub from the first sub. The method may include also coupling the first sub to the second sub with a connector that includes an electrical connection. The method may further include enlarging a diameter of a wellbore using the member, retrieving the first sub from a wellbore, and/or disconnecting the radially projecting member at a rig positioned over the wellbore.

In aspects, the present disclosure provides a method for conducting a wellbore operation that includes: connecting a conductor of the first sub to a conductor of the second sub; conveying the first sub and the second sub into a wellbore; cutting a surface in the wellbore using a plurality of cutters positioned in the first sub; transmitting signals along the conductors while the first and the second sub are in the wellbore; retrieving the first sub and the second sub to the surface; and replacing at least one cutter of the plurality of cutters with a replacement cutter while the conductors of the first sub and the second sub are connected to one another; and conveying the first sub and the second sub again into the wellbore without uncoupling the conductors of the first sub and the second sub.

In aspects, an apparatus for performing a wellbore operation may include a sub having at least one conductor connected to a connector; and at least one radially projecting member removably coupled to the sub. In another embodiment, an apparatus for performing wellbore operations may include a section of a drill string that includes a first sub and a second sub. The first sub may include at least one conductor, a connector connected to the at least one conductor; and at least one radially projecting member coupled to the first sub. The at least one radially projecting member may be removed from the first sub while the first sub is connected to the second sub.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

In aspects, the present disclosure provides a cutting structure that may be replaced without breaking the connections between a tool sub supporting that cutting structure and adjacent subs or joints. As used herein, the term "sub" broadly refers to any structure that can support one or more components, tools, or devices. A sub may be of any shape or configuration, may be skeletal, or a complete enclosure. Moreover, a "sub" may be open to the environment or a sealed enclosure. Also, the sub is not limited to any particular material or method of manufacture. Cutting structures experience wear during use. In instances where the tool sub is in an assembly that uses electrical and data connections, breaking the electrical/data connections can be time consuming and can compromise the operational integrity of these connections. As will become apparent from the disclosure below, embodiments of the present disclosure allow a tool sub having cutting structures to be serviced at a rig or other suitable work area without breaking one or more of these connections.

Figure 1:
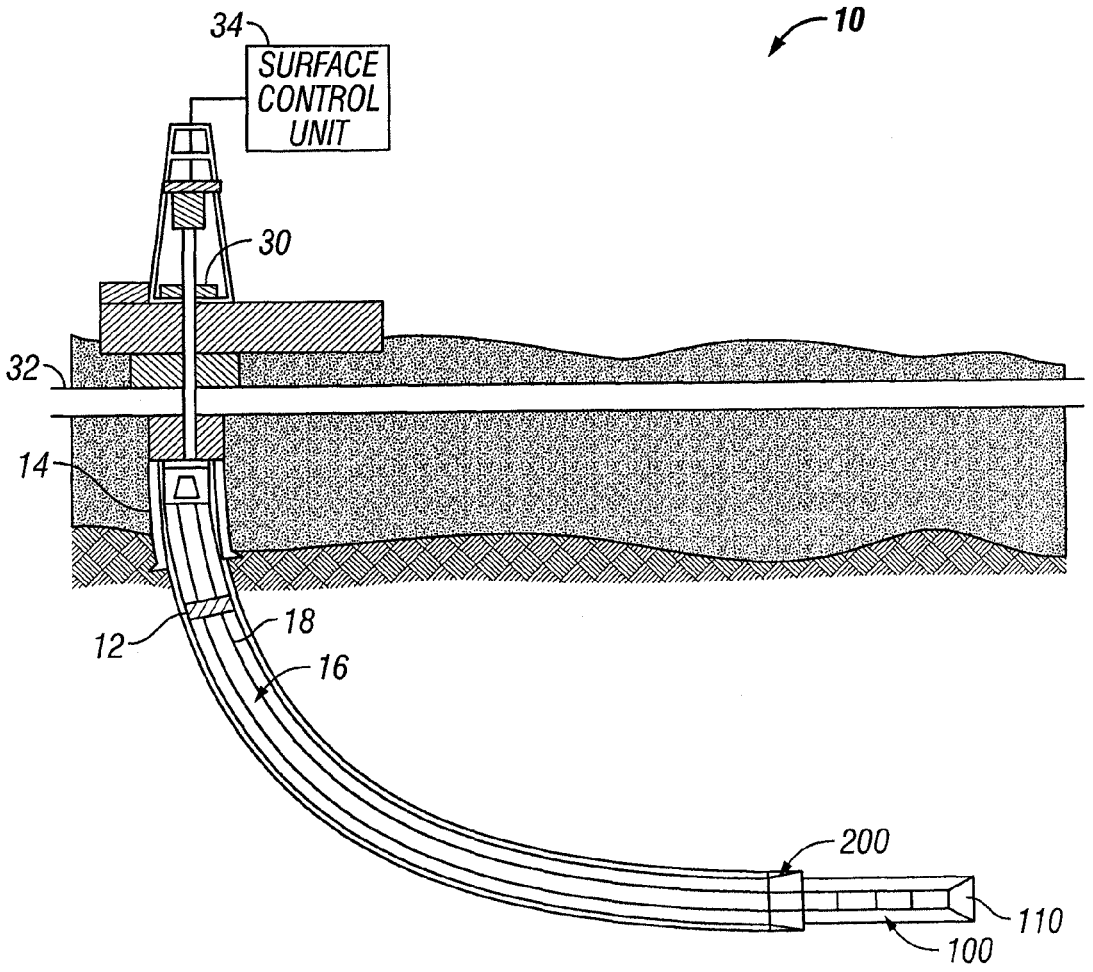
FIG. 1 illustrates a wellbore construction system made in accordance with one embodiment of the present disclosure.

FIG. 1 is a schematic diagram showing a drilling system 10 for drilling wellbores according to one embodiment of the present disclosure. FIG. 1 shows a wellbore 12 that includes a casing 14 with a drill string 16. The drill string 16 includes a tubular member 18 that carries a bottomhole assembly (BHA) 100 at a distal end. The tubular member 18 may be made up by joining drill pipe sections. The drill string 16 extends to a rig 30 at the surface 32. The drill string 16, which may be jointed tubulars or coiled tubing, may include power and/or data conductors such as wires for providing bidirectional communication and power transmission. A top drive (not shown), or other suitable rotary power source, may be utilized to rotate the drill string 16. A controller 34 may be placed at the surface 32 for receiving and processing downhole data. The controller 34 may include a processor, a storage device for storing data, and computer programs. The processor accesses the data and programs from the storage device and executes the instructions contained in the programs to control the drilling operations.

Figure 2:
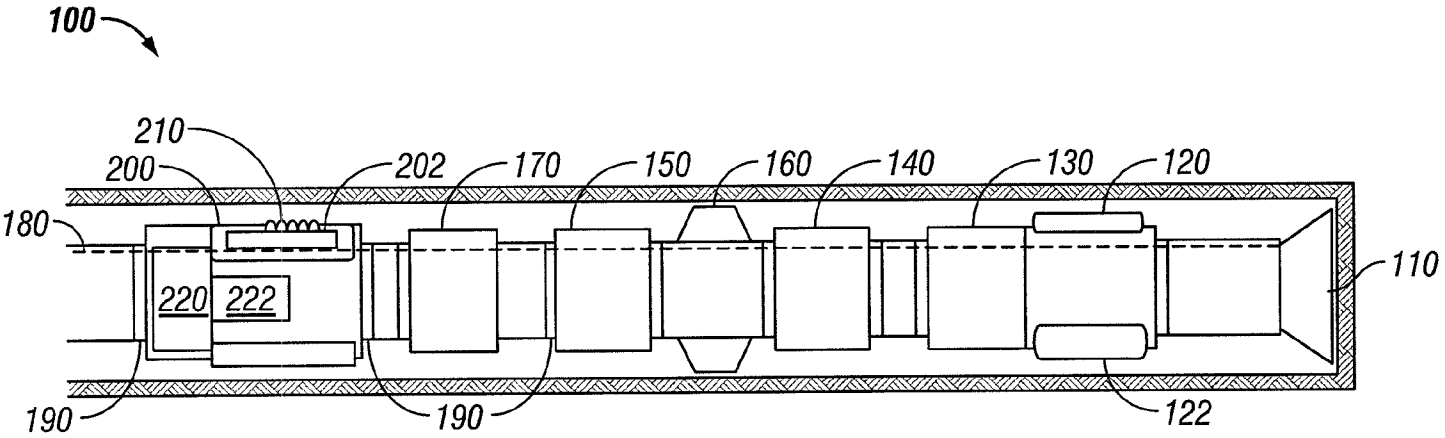
FIG. 2 schematically illustrates a BHA that includes a hole enlargement device made in accordance with one embodiment of the present disclosure.

Referring now to FIG. 2, in one embodiment, the BHA 100 may include a drill bit 110, a steering device 120, a drilling motor 130, a sensor sub 140, a bidirectional communication and power module (BCPM) 150, a stabilizer 160, a formation evaluation (FE) module 170, and a hole enlargement device 200. Each of these devices and components may be considered "subs." Some or all of these devices use electrical power and transmit/receive data signals. To enable power and/or data transfer across the subs of the BHA 100, the BHA 100 may include one or more power and/or data transmission lines 180. The power and/or data transmission line 180 may extend along the entire length of the BHA 100. The lines 180 may be embedded or separate conductors made of metal wires, optical fibers, or any other suitable data conveying media. The joints or ends of the subs of the BHA 100 may include suitable connectors 190 to establish power and/or data transmission at the mating portions of the subs making up the BHA 100. Exemplary connectors 190 may include slip rings and other suitable connection devices. For example, a sub or drill pipe may include insulated contact rings positioned in a shoulder at both ends of the pipe (e.g., the threaded pin and box ends). The contact rings in the sub or pipe body may be connected by a conductor (e.g., line 180) that spans the length of the body. Thus, when a pipe body is made up with an adjoining segment of pipe, the contact ring in the first segment of pipe makes contact with a corresponding contact in the adjacent pipe section.

Figure 3:
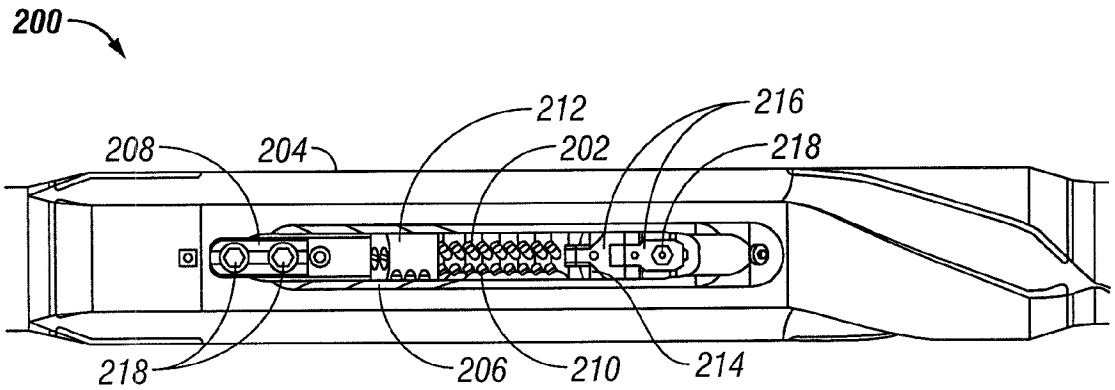
FIG. 3 illustrates a top view of the hole enlargement device of FIG. 2.
Figure 4:
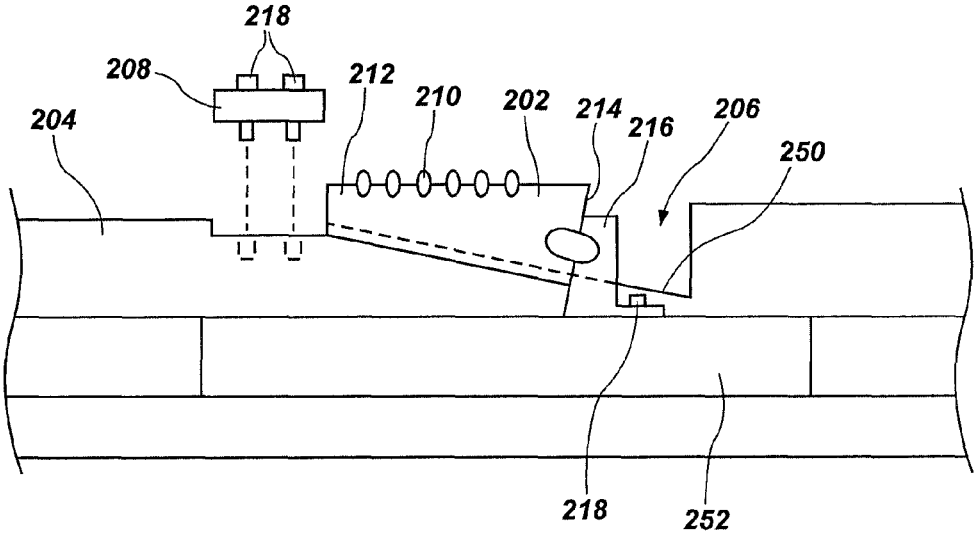
FIG. 4 illustrates a partial cross-sectional side view of the hole enlargement device of FIG. 3.

Referring now to FIG. 3, there is shown a top view of one embodiment of a hole enlargement device 200 in accordance with the present disclosure. These devices may also be referred to as hole openers. The hole enlargement device 200 may include expandable cutters 202 that are circumferentially disposed in a sub or housing 204. The cutters 202 may be disposed in a bay or pocket 206 that is open to the environment. The cutters 202 may be extended substantially simultaneously to form a wellbore having a generally circular cross-sectional shape. That is, the cutters 202 do not preferentially cut the wellbore wall, because such a cutting action would yield an asymmetric cross-sectional shape (e.g., a non-circular shape). When projected radially, the cutters 202 scrape, break-up and disintegrate the wellbore surface formed initially by the drill bit 110 (FIGS. 1 and 2). Referring to FIGS. 3 and 4, in one arrangement, a stop block 208 is positioned on the housing 204 to engage the cutters 202. The cutters 202 have cutting elements 210 disposed on one end 212. On the opposing end 214, the cutters 202 are fixed to a translating member 216. When actuated, the translating members 216 push the cutters 202 along a ramped surface 250 until the end 212 of the cutters 202 touch the stop block 208. As the cutters 202 slide axially in the pocket 206, the ramped surface 250 guides the cutters 202 radially outward. The travel of the cutters 202, and the diameter of the hole formed, may be adjusted by shifting the location of the stop block 208. Fasteners 218 may be used to secure the stop block 208 to the housing 204 and the translating members 216 to a moving sleeve 252 inside the housing. The term "radially projecting member" generally refers to any member that extends out beyond the outer circumferential surface of a sub or housing.

Referring now to FIG. 2, the cutters 202 may, in real-time, be extended and retracted by an actuation unit 220 that moves the sleeve (not shown) and translating members 216 (FIG. 3). In one arrangement, the actuation unit 220 utilizes pressurized hydraulic fluid as the energizing medium. For example, the actuation unit may include a piston disposed in a cylinder, an oil reservoir, and valves that regulate flow into and out of the cylinder. The hydraulic fluid may be pressurized using pumps and/or by the pressurized drilling fluid flowing through the bore of the drill string 16. An electronics package 222 controls valve components such as actuators in response to surface and/or downhole commands and transmits signals indicative of the condition and operation of the hole enlargement device 200. Position sensors (not shown) may provide an indication as to the radial position of the cutters 202. The electronics package 222 may communicate with the BCPM 150 via a line 180. Thus, for instance, surface personnel may transmit instructions from the surface that cause the electronics package 222 to operate the valve actuators for a particular action (e.g., extension or retraction of the cutting elements 210). A signal indicative of the position of the cutters 202 may be transmitted via the line 180 to the BCPM 150 and, ultimately, to the surface.

It should be appreciated that surface personnel can activate the hole enlargement device 200 to expand/retract a plurality of times during a single trip of the BHA 100 in the well.

Referring now to FIGS. 1 and 2, in one method of use, when it is desired to replace one or more cutters 202, the drill string 16 is retrieved to the surface (or "tripped up" the surface). This process usually involves removing stands of pipe from the drill string 16. Once the BHA 100 is accessible to surface personnel, the BHA 100 may be secured without breaking the connections 190 of the subs making up the BHA 100, which as noted previously, may have relatively sensitive electrical/fiber optic connections. Specifically, one or both of the connections 190 associated with the housing 204 remain connected to adjacent subs to which they are connected. Thus, the integrity of these connections may be preserved. That is, these connections may still be capable of conveying information bearing signals (e.g., EM, electrical, optical, etc.).

Referring now to FIG. 3 and FIG. 4, personnel may next remove the fasteners 218 and stop block 208 and slide the cutter 202 and the translation members 216 axially along the pockets 206. A replacement cutter 202 may now be installed into the hole enlargement device 200. Once the necessary cutters 202 have been removed and replaced, the BHA 100 may be conveyed or "tripped" into the well and further well operations may commence. Thus, the hole enlargement device 200 has been serviced without subjecting the signal connection between the subs to service-related stresses. It should be understood that the fasteners 218 or other fastening device used is accessible to surface personnel without disassembling the hole enlargement device 200. It should also be appreciated that the cutter replacement activity described above minimizes the impact of this operation on the electrical connections associated with the BHA 100.

Hole openers or hole enlargement devices in accordance with the present disclosure may be used to form a wellbore having a diameter larger than that formed by the drill bit in a variety of applications. For instance, in some applications, constraints on wellbore geometry during drilling may result in a relatively small annular space in which cement may flow, reside and harden. In such instances, the annular space may need to be increased to accept an amount of cement necessary to suitably fix a casing or liner in the wellbore. In other instances, an unstable formation such as shale may swell to reduce the diameter of the drilled wellbore. To compensate for this swelling, the wellbore may have to be drilled to a larger diameter while drilling through the unstable formation.

Furthermore, it may be desired to increase the diameter of only certain sections of a wellbore in real-time and in a single trip. In still other instances, sidetracking operations may require forming an open hole section in a cased wellbore.

It should be understood, however, that the present disclosure is not limited to replacing cutters for hole enlargement devices such as reamers. For example, referring to FIG. 2, in some embodiments, the hole enlargement device 200 may use arms or pads that do not include cutters. Rather, the hole enlargement device 200 may use extensible members that engage a surface of an expandable wellbore tubular to expand the diameter of such a tubular. In still other embodiments, the stabilizer 160 may be modified to use replaceable blades or extensible members. In yet other embodiments, a steering device 120 that uses extensible pads 122 may be configured to have the pads removable as described above. Pads, blades, and cutters are illustrative of members that project radially out of a sub. In any of these embodiments, it should be appreciated that the pads, blades, or other extensible member may be replaced without disconnecting a connection that has sensitive elements such as electrical components.

From the above, it should be appreciated that what has been described includes, in part, a method for conducting a wellbore operation that includes disconnecting a radially projecting member from a first sub without uncoupling a second sub from the first sub. The method may also include coupling the first sub to the second sub with a connector that includes an electrical connection. The method may further include enlarging a diameter of a wellbore using the member, retrieving the first sub from a wellbore, and/or disconnecting the first sub at a rig positioned over the wellbore. An associated apparatus may include a sub having at least one conductor connected to a connector; and at least one radially projecting member removably coupled to the sub.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. A method for conducting a wellbore operation, comprising:

pushing a cutter having a plurality of cutting elements thereon with a translating member axially along a pocket and along a ramped surface of a first sub until an end of the cutter touches a stop block disposed proximate an open end of the pocket and fastened to the first sub with fasteners, pushing the cutter along the ramped surface causing the cutter to extend radially outward from the first sub, wherein the ramped surface extends at an angle to a longitudinal axis of the first sub;

using the cutter in a wellbore; and replacing the cutter without uncoupling a second sub from the first sub, replacing the cutter comprising:

removing the fasteners from the stop block and first sub;

removing the stop block from the first sub;

sliding the cutter axially along the pocket and out of the open end of the pocket;

sliding a replacement cutter into the open end of the pocket and axially along the pocket along the ramped surface; and fastening the stop block to the first sub with the fasteners.

2. The method of claim 1, further comprising coupling the first sub to the second sub with a connector that includes an electrical connection.

3. The method of claim 2, wherein the first sub includes a conductor coupled to the electrical connection.

4. The method of claim 3, further comprising radially displacing the cutter at least partially out of the pocket of the first sub using an actuator.

5. The method of claim 1, further comprising: conveying the first sub into the wellbore, and using the plurality of cutting elements of the cutter to cut one of: (i) an earth wall of the wellbore, and (ii) a wellbore tubular.

6. The method of claim 1, further comprising enlarging a diameter of the wellbore using the plurality of cutting elements of the cutter.

7. The method of claim 1, further comprising:

conveying the first sub into the wellbore;

using the plurality of cutting elements of the cutter to cut a surface in the wellbore, and retrieving the first sub from the wellbore.

8. The method of claim 7, wherein the cutter is disconnected at a rig positioned over the wellbore.

9. A method for conducting a wellbore operation, comprising:

connecting a conductor of a first sub to a conductor of a second sub;

conveying the first sub and the second sub into a wellbore;

pushing a cutter having a plurality of cutting elements thereon axially with a translating member along a pocket and along a ramped surface of a first sub until an end of the cutter touches a stop block disposed proximate an open end of the pocket and fastened to the first sub with fasteners, pushing the cutter along the ramped surface causing the cutter to extend radially outward from the first sub, wherein the ramped surface extends at an angle to a longitudinal axis of the first sub;

cutting a surface in the wellbore using the plurality of cutting elements of the cutter;

transmitting signals along the conductors while the first and the second sub are in the wellbore;

retrieving the first sub and the second sub to the surface;

replacing the cutter without uncoupling the second sub from the first sub, replacing the cutter comprising:

removing the fasteners from the stop block and first sub;

removing the stop block from the first sub;

sliding the cutter axially along the pocket and out of the open end of the pocket;

sliding a replacement cutter into the open end of the pocket and axially along the pocket along the ramped surface; and fastening the stop block to the first sub with the fasteners; and conveying the first sub and the second sub again into the wellbore without uncoupling the conductors of the first sub and the second sub.

10. The method of claim 9, further comprising:

retaining the cutter in the first sub with the stop block fastened to the first sub.

11. The method of claim 9, further comprising: forming a signal connection between the conductors of the first and second subs using a connector, wherein the replacement step is performed without disconnecting the connector from the conductors of one of: (i) the first sub, and (ii) the second sub.

12. An apparatus for performing a wellbore operation, comprising:

a section of a drill string that includes a first sub coupled to a second sub, wherein the first sub includes:

at least one conductor;

a connector connected to the at least one conductor;

a cutter disposed in and translatable axially along a pocket in the first sub, the cutter having a plurality of cutting elements disposed thereon;

a translating member configured to push the cutter axially along the pocket and along a ramped surface, the cutter configured to extend radially outward from the first sub upon translation of the cutter along the pocket and ramped surface, wherein the ramped surface extends at an angle to a longitudinal axis of the first sub; and a stop block disposed proximate an open end of the pocket and fastened to the first sub with fasteners, the stop block configured to retain the cutter within the pocket and to block an axial translation of the cutter, the stop block and fasteners removable from the first sub, the cutter configured to be replaced with a replacement cutter without uncoupling the second sub from the first sub, the cutter further configured to slide axially along the pocket and out of the open end of the pocket upon removal of the stop block, wherein a replacement cutter is configured to slide into the open end of the pocket and slide axially along the pocket, and wherein the stop block is refastenable to the first sub with the fasteners after replacing the cutter.

13. The apparatus of claim 12, wherein the connector includes an electrical connection in signal communication with the at least one conductor, the connector coupling the at least one conductor of the first sub to at least one conductor associated with the second sub.

14. The apparatus of claim 12, wherein the first sub includes an actuator configured to displace the translating member axially at least some distance along the pocket of the first sub.

15. The apparatus of claim 12, wherein the cutter is configured to cut one of: (i) a surface of a wellbore tubular, and (ii) an earth wall of a wellbore.

16. The apparatus of claim 12, wherein the cutter is confined to a specified axial travel within the pocket by the stop block disposed proximate an open end of the pocket of the first sub.

* * * * *

UNITED STATES PATENT AND TRADEMARK OFFICE

CERTIFICATE OF CORRECTION

PATENT NO. : 9,051,792 B2
APPLICATION NO. : 13/186915
DATED : June 9, 2015
INVENTOR(S) : Wolfgang E. Herberg and Ines Gruetzmann It is certified that error appears in the above-identified patent and that said Letters Patent is hereby corrected as shown below:

On the title page:

In ITEM (75) Inventors: change "Niedersachsen (DE);" to --Eversen (DE);--

Signed and Sealed this
Twenty-second Day of December, 2015

Michelle K. Lee

Michelle K. Lee
*Director of the United States Patent and Trademark Office*